US009474950B1

(12) United States Patent
McDowell

(10) Patent No.: US 9,474,950 B1
(45) Date of Patent: Oct. 25, 2016

(54) GOLF CLUB COLLER

(71) Applicant: Scott M McDowell, Castle Pines, CO (US)

(72) Inventor: Scott M McDowell, Castle Pines, CO (US)

( * ) Notice: Subject to any disclaimer, the term of this patent is extended or adjusted under 35 U.S.C. 154(b) by 0 days.

(21) Appl. No.: 14/145,438

(22) Filed: Dec. 31, 2013

Related U.S. Application Data

(60) Provisional application No. 61/756,176, filed on Jan. 24, 2013.

(51) Int. Cl.
*A63B 57/00* (2015.01)

(52) U.S. Cl.
CPC ..... *A63B 57/0075* (2013.01); *A63B 57/0068* (2013.01)

(58) Field of Classification Search
CPC ..... A63B 57/0075; A63B 57/0068
See application file for complete search history.

(56) References Cited

U.S. PATENT DOCUMENTS 4,248,430 A * 2/1981 Kepler ..... A63B 47/02 294/19.2
4,662,415 A * 5/1987 Proutt ..... A63B 53/14 150/160
4,869,511 A * 9/1989 Spoonster, Sr. ... A63B 69/3638 473/203
5,054,777 A * 10/1991 Borden ..... A63B 57/00 15/113
5,417,426 A * 5/1995 Bayer ..... A63B 57/0075 473/285
6,033,322 A * 3/2000 England ..... A63B 57/0068 473/406
6,095,934 A * 8/2000 Ohama ..... A63B 57/0031 224/918
6,102,201 A * 8/2000 Marston ..... A45F 5/021 206/315.1
6,162,137 A * 12/2000 Jones ..... A24F 13/26 30/109
6,220,973 B1 * 4/2001 Hsu ..... A63B 57/0031 473/406
6,428,430 B1 * 8/2002 Chong ..... A63B 57/0068 473/406
6,491,594 B1 * 12/2002 Dacosta ..... A01B 1/24 473/408
6,638,177 B1 * 10/2003 Wang ..... A63B 47/02 294/19.2

(Continued)

FOREIGN PATENT DOCUMENTS

JP 2000176062 A * 6/2000
JP 2000176063 A * 6/2000

*Primary Examiner* — Stephen Blau
(74) *Attorney, Agent, or Firm* — Patent Law Offices of Rick Martin, P.C.

(57) ABSTRACT

A collar for outfitting a golf club or putter under its handle is presented. The collar is a clamshell-type accessory that can be secured with screws around various diameter shafts. One side of the collar has a recess for a divot repair tool. Optionally this tool is metal and a magnet under the recess secures it. Optionally two or more ball markers fit into other recesses. Magnets may secure metal ball markers or plastic versions may also be secured depending on size.

17 Claims, 10 Drawing Sheets

(56) References Cited

U.S. PATENT DOCUMENTS 6,656,062 B2 * 12/2003 Vochezer ..... A63B 57/0068 473/408
6,893,357 B1 * 5/2005 Bennett ..... A63B 55/10 473/282
6,942,584 B2 * 9/2005 Kvitek ..... A63B 45/02 473/406
7,134,302 B2 * 11/2006 Gorst ..... E05B 73/0041 340/572.9
7,458,900 B1 * 12/2008 Park ..... A63B 21/0088 473/226
7,621,819 B1 * 11/2009 Neu ..... A63B 57/0068 172/375
7,628,708 B2 * 12/2009 Metz ..... A63B 69/3608 473/213
7,771,287 B2 * 8/2010 Staszak ..... A63B 55/10 473/282
D643,494 S * 8/2011 Book ..... D21/793
8,025,584 B2 * 9/2011 Foley ..... A63B 57/0062 473/178
8,500,609 B1 * 8/2013 Williams ..... A63C 11/228 135/65
8,529,381 B2 * 9/2013 Solheim ..... A63B 57/0068 473/408
2005/0288122 A1 * 12/2005 Pare ..... A63B 55/10 473/282
2006/0070410 A1 * 4/2006 Fuss ..... E05B 73/0017 70/57.1
2006/0183569 A1 * 8/2006 Shwartz ..... A63B 57/0075 473/406
2008/0230435 A1 * 9/2008 Cope ..... A63B 55/008 206/579
2009/0209369 A1 * 8/2009 Smith ..... A63B 57/0018 473/406
2010/0113175 A1 * 5/2010 Gill ..... A63B 57/0068 473/285
2010/0292022 A1 * 11/2010 Stites ..... A63B 53/10 473/318
2011/0000946 A1 * 1/2011 Stretcher ..... A63B 57/00 224/584
2011/0207558 A1 * 8/2011 Huffman ..... A63B 57/0068 473/406
2014/0158566 A1 * 6/2014 Maeng ..... A63B 55/007 206/315.2
2014/0349783 A1 * 11/2014 Haley ..... A63B 57/0075 473/406
2015/0033543 A1 * 2/2015 Markwardt ..... B25B 5/10 295/559

* cited by examiner

GOLF CLUB COLLER

The following is a non-provisional application for patent claiming priority to U.S. patent Ser. No. 61/756,176 filed Jan. 24, 2013.

FIELD OF INVENTION

The present invention relates to a removable collar that attaches to a golf club shaft, especially a putter. The collar has magnet fasteners for a divot repair tool and ball markers.

BACKGROUND OF THE INVENTION

Below follows a summary of the closest known prior art. Ball marker and divot repair tools are oftened carried in trouser pockets for accessibility but can be heavy and/or uncomfortable to carry. Golfers need a way to organize and carry these tools in a non-cumbersome manner.

U.S. Pat. No. 3,744,913 (1973) to Dien discloses a modified putter handle. The top of the handle is replaced with a cover that has a slot. The specially made divot repair tool prongs slide into the slot. The divot repair tool handle has a hinge attachment to the prongs. This handle can receive a single ball marker which is also custom made to fit into the divot repair tool handle. The problems with this invention include modifying a putter handle, custom manufacturing three parts and using a hinged handle on the divot repair tool. Additionally, only one ball marker is stored.

U.S. Pat. No. 3,791,652 (1974) to Schuler discloses opening the top of the putter handle. A plug is inserted, one ball marker slides inside the divot repair tool handle, then the prongs on the divot repair tool slide into holes on top of the plug. The problems with this invention include modifying the putter, handling the divot repair tool to get access to the ball marker, and holding only one ball marker.

U.S. Pat. No. 6,758,762 (2004) to Markwood discloses a custom putter grip. The grip has a slot in the top for receiving the prongs of a divot repair tool. The handle of the divot repair tool protrudes above the putter handle which will make it look different from all other clubs. Two ball markers clip onto the top sides of the club. The problems with this system include making a custom putter, the top of the handle being cluttered with ball markers, and the handle of the divot repair tool.

What is needed in the art is an accessory to a standard putter that can hold a divot repair tool and several ball markers. The present invention meets these needs and provides a collar that can clamp on various diameter golf club shafts.

SUMMARY OF THE INVENTION

The main aspect of the present invention is to provide a clamp on collar for a golf club or putter shaft, wherein the collar receives a divot repair tool and at least two ball markers.

Another aspect of the present invention is to provide adjustment means in the collar to fit to various width golf club shafts.

Another aspect of the present invention is to imbed magnets in the collar to secure a metal divot repair tool and metal ball markers.

The preferred embodiment provides a clamshell-like, two part, flexible plastic collar that fits around a club shaft. The collar is attached to a club or putter shaft just under the handle with four screws. The outside of the collar has an indent for a metal divot repair tool on one side and two indents for metal ball markers on the opposite side. Magnets are mounted under the indents to secure the removable divot repair tool and ball markers. Finger slots are provided to remove the removable divot repair tool and ball markers.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
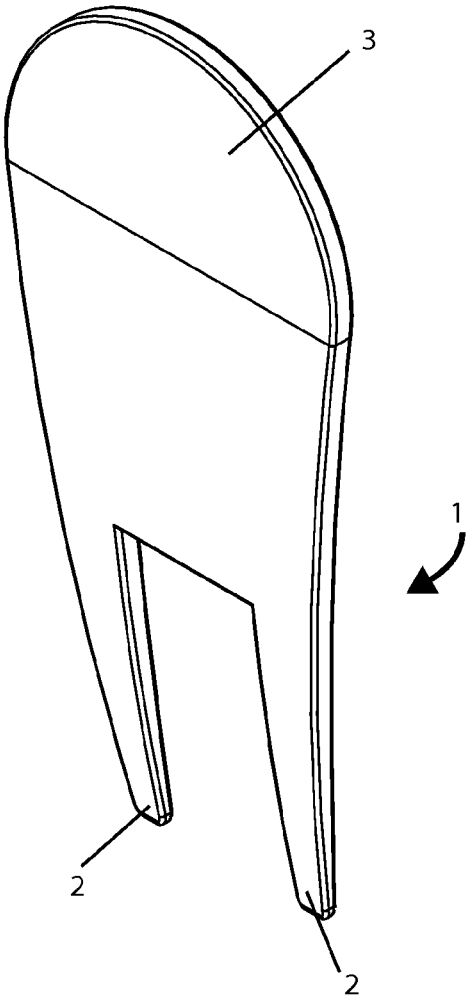
FIG. 1 is a side perspective view of a metal divot repair tool custom made to fit the collar.
Figure 2:
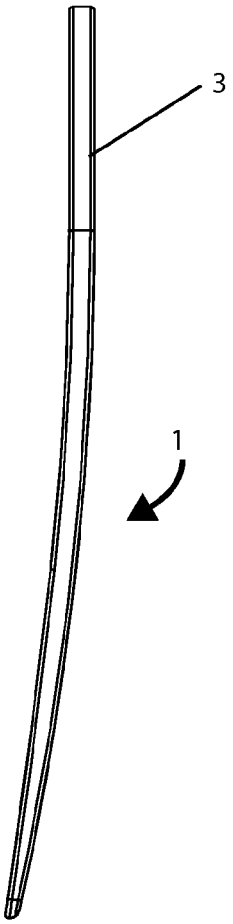
FIG. 2 is a side elevation view of the divot repair tool.

Referring first to FIGS. 1 and 2, a divot repair tool 1 has prongs 2 and a handle 3. Preferably the tool is metal so it can be magnetized. The tool 1 has a slightly arched profile as seen in FIG. 2.

Figure 3:
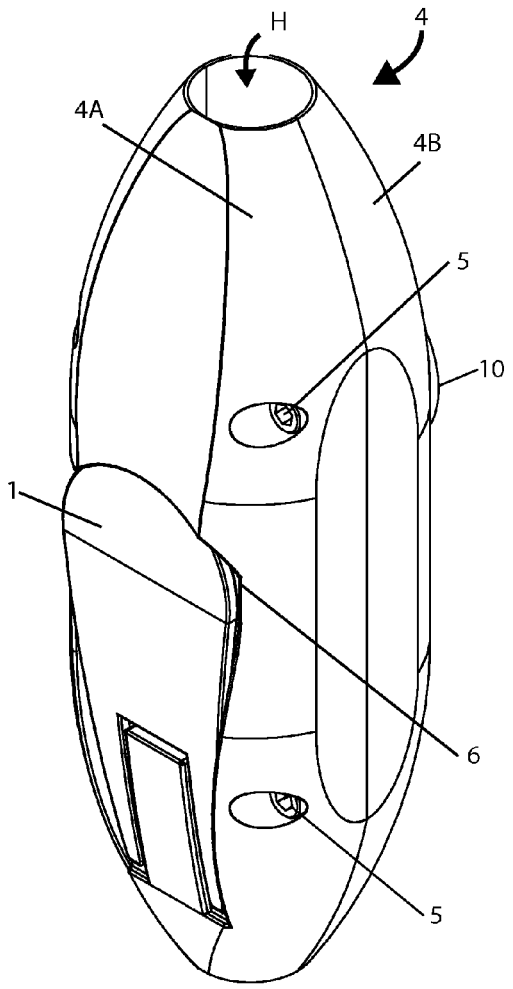
FIG. 3 is a top perspective view of the collar showing the divot repair tool attached.
Figure 4:
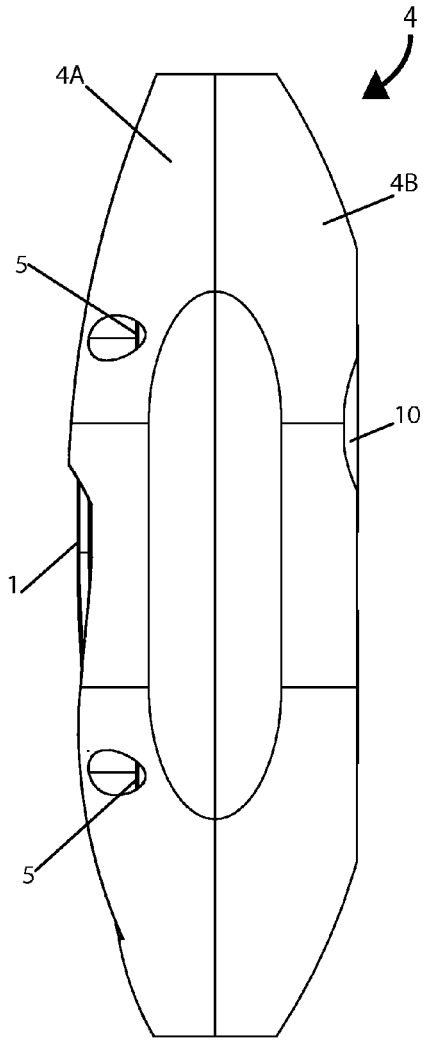
FIG. 4 is a side elevation view of the collar.

Referring next to FIGS. 3 and 4, the collar 4 clamps around a golf club shaft by means of the hollow H. The divot repair tool half 4A has four screws 5 which connect it to the ball marker half 4B. The arcuate recess 6 receives the divot repair tool 1. A ball marker 10 is shown. The overall shape of the collar 4 is similar to a slender elongated football to minimize interference with objects.

Figure 5:
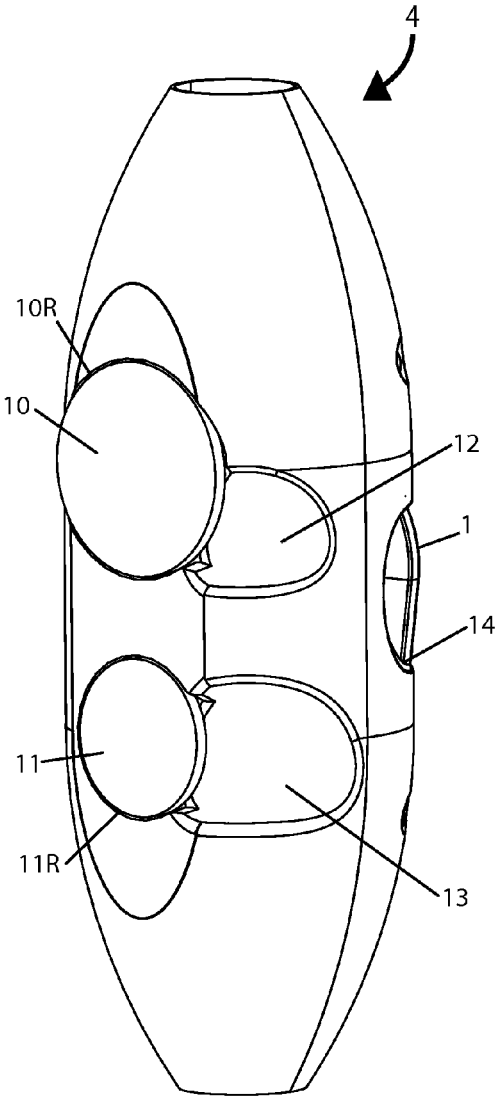
FIG. 5 is a side elevation view of the collar showing the finger slots and the two ball markers.
Figure 6:
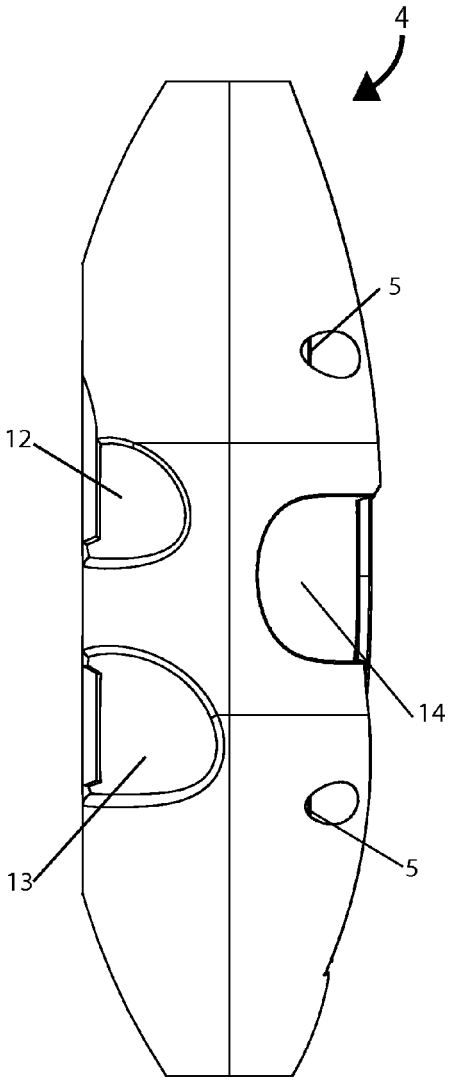
FIG. 6 is a side elevation view showing the two ball markers and the divot repair tool.

Referring next to FIGS. 5 and 6, the two ball markers 10, 11 may be the same size or one smaller as shown. They may be standard store bought markers of plastic that snap into their recess 10R, 11R without magnets. Finger slots 12, 13, 14 allow the golfer to pry the items off the collar.

Figure 7:
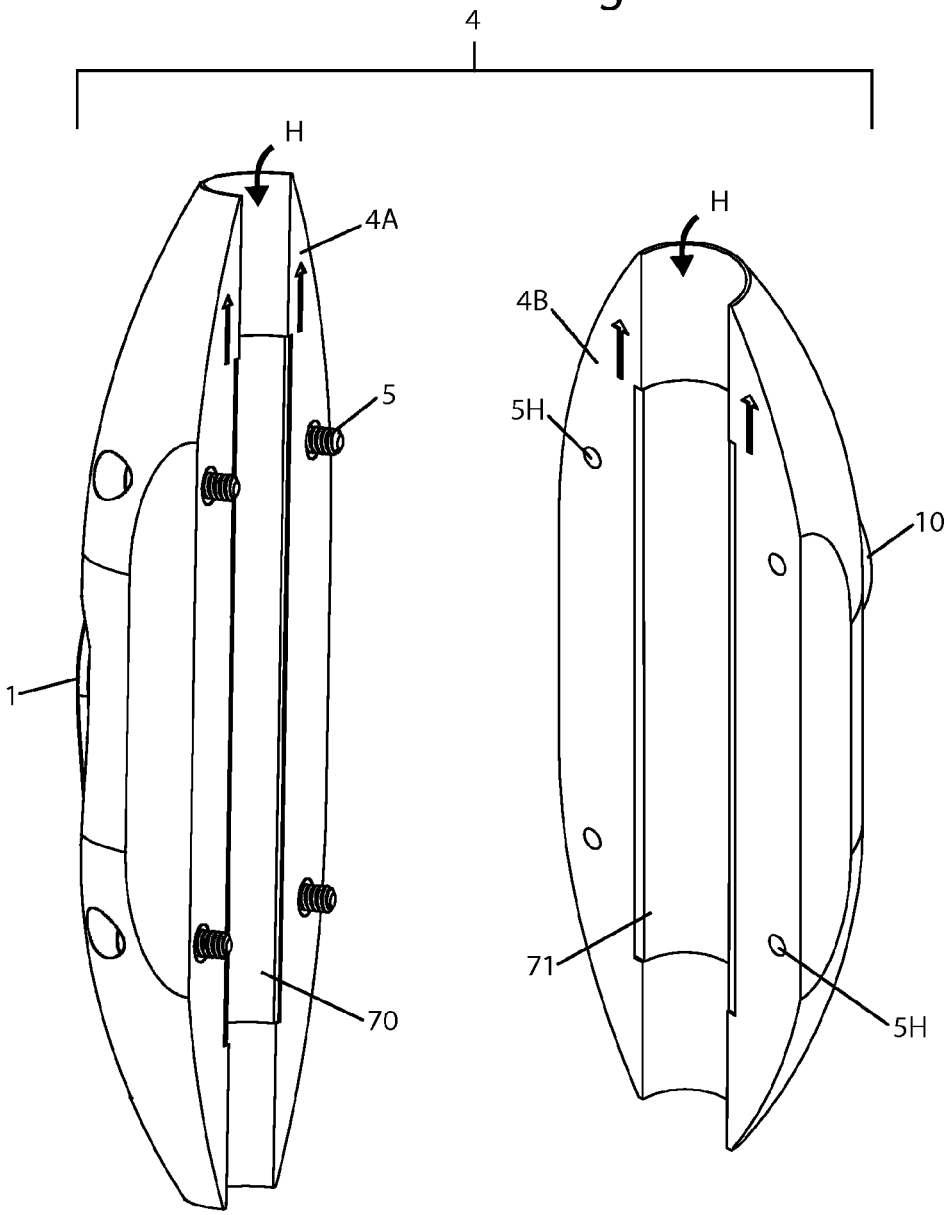
FIG. 7 is an exploded view showing the two clam shell halves of the collar.

Referring next to FIG. 7, the screws 5 thread into holes 5H. In order to adjust to various diameter shafts, pads 70, 71 maybe inserted into hollow H.

The internal inserts, pads 70, 71 are made of a compressible rubber or silicone like material, or of soft durometer. The purpose is to use a compressive material that will allow for the product to be tightened down on multiple sized putter shafts and fit a relatively broad range of shaft diameters.

Figure 8:
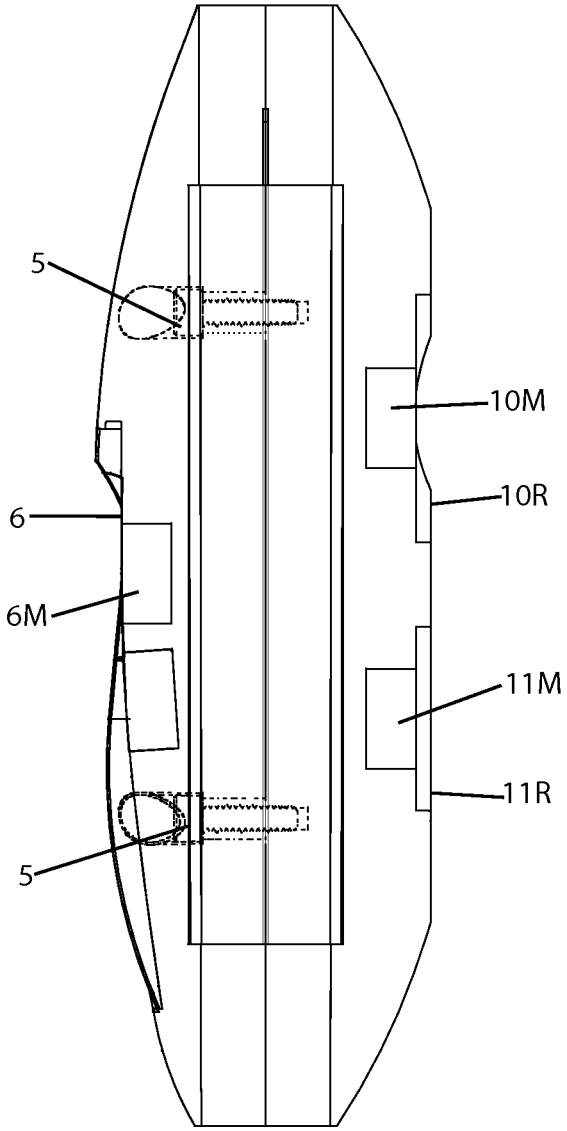
FIG. 8 is a side cutaway view showing the mounting magnets.

Referring next to FIG. 8, recess 6 has a magnet 6 M fastened, perhaps by glue, at the surface to removably secure a metal divot repair tool. Recess 10R has magnet 10M secured at its surface. Recess 11R has a magnet 11M secured at its surface.

Several magnets are built into the housing, flush with the surface of the housing. The purpose is twofold. First, the magnets hold the divot repair tool and the ball markers in place when not in use. Second, they magnetically guide and pull the metallic tools into place as they are inserted back into the housing for storage. These magnets are gauged to the perfect strength to ensure the tools will not fall out of the housings or vibrate while striking the golf ball at the same time being relatively easy to remove and install.

Figure 9:
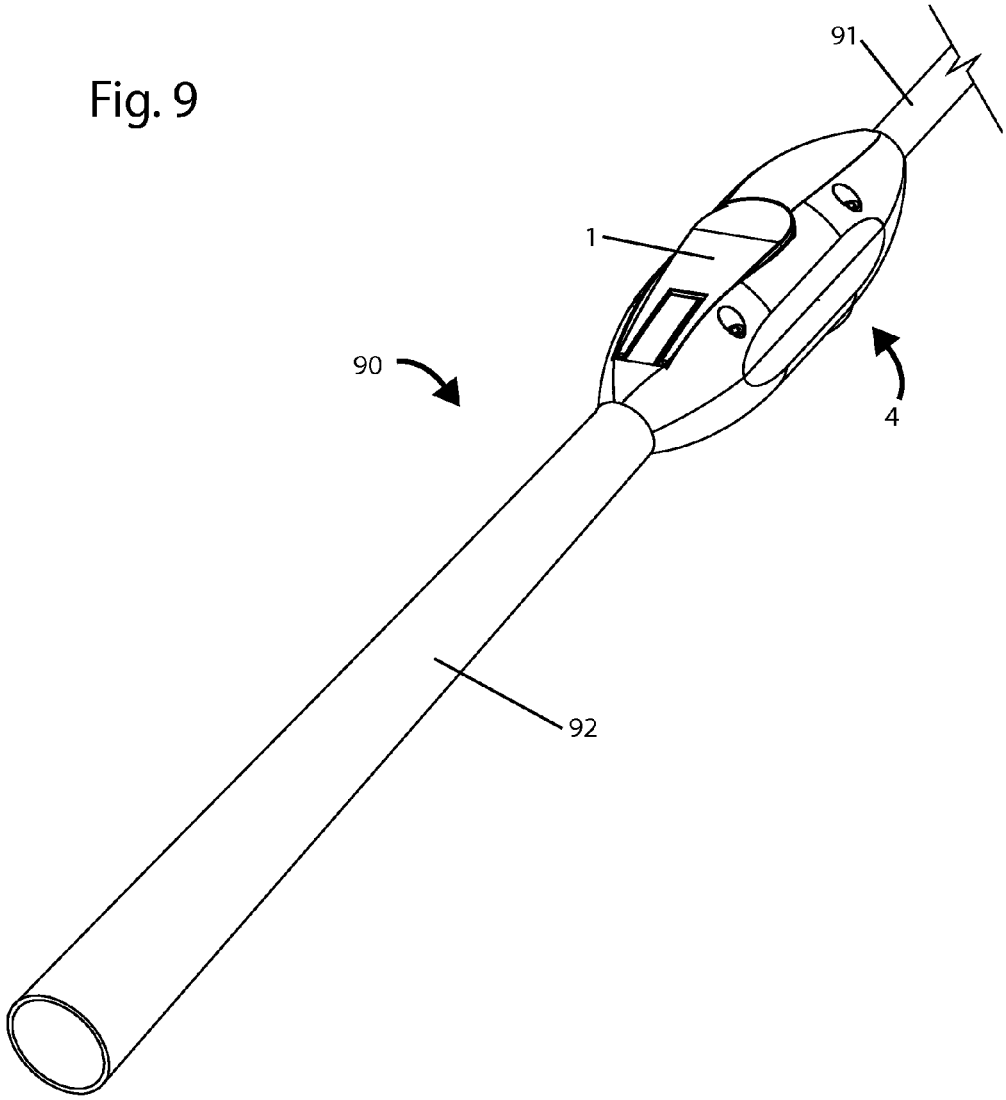
FIG. 9 is a top perspective view of a putter with the collar installed.
Figure 10:
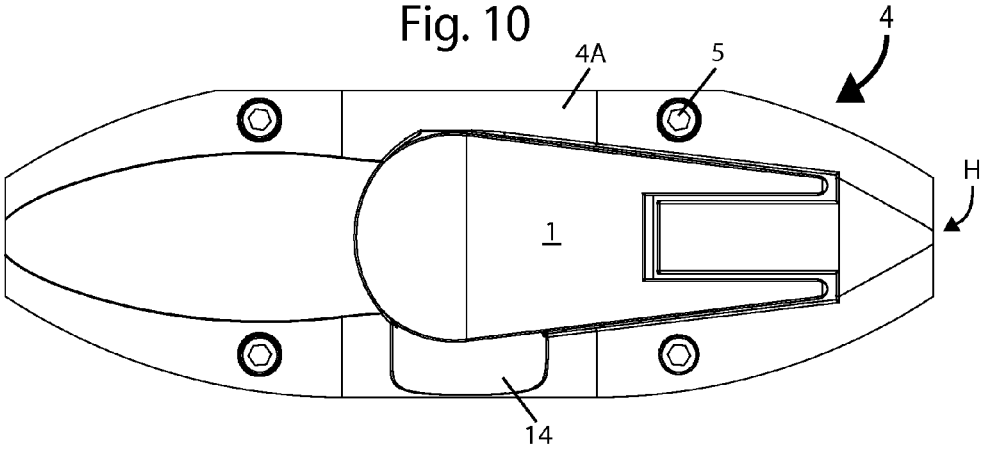
FIG. 10 is a side elevation view of the front of the collar which holds the divot repair tool.
Figure 11:
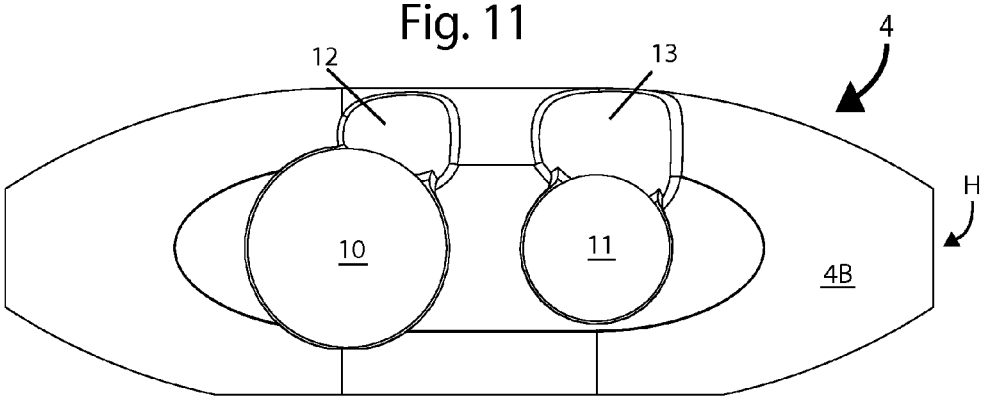
FIG. 11 is a side elevation view of the back of the collar which holds the ball markers.
Figure 12:
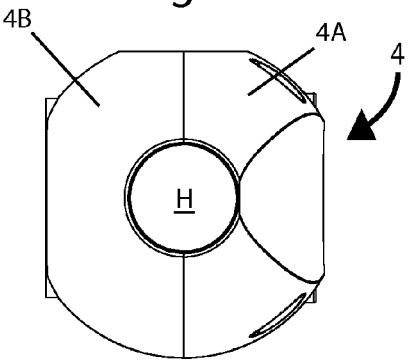
FIG. 12 is a top plan view of the collar.
Figure 13:
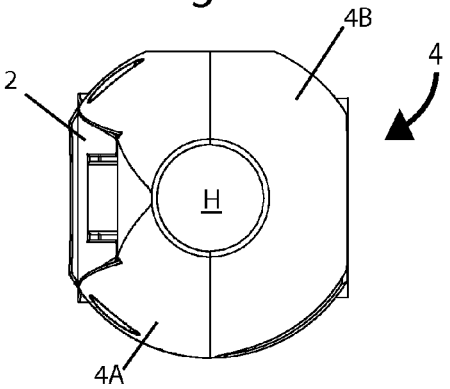
FIG. 13 is a bottom plan view of the collar.

Referring next to FIG. 9, a putter 90 has a handle 92 and a shaft 91. The collar 4 is attached at the base of the handle 92. Its slender elongated football type shape is esthetically appealing. The close proximity of the ball markers and divot repair tool to the golfer enhances his efforts on the green.

Referring next to FIGS. 10, 11, 12, and 13, the unique shape of the housing is specifically designed to reduce interference or resistance while being pulled from or inserted into the golf bags while full with other golf clubs. As seen in FIG. 9, the diameter of the collar is only slightly larger than that of the handle 92 of the club.

Figure 14:
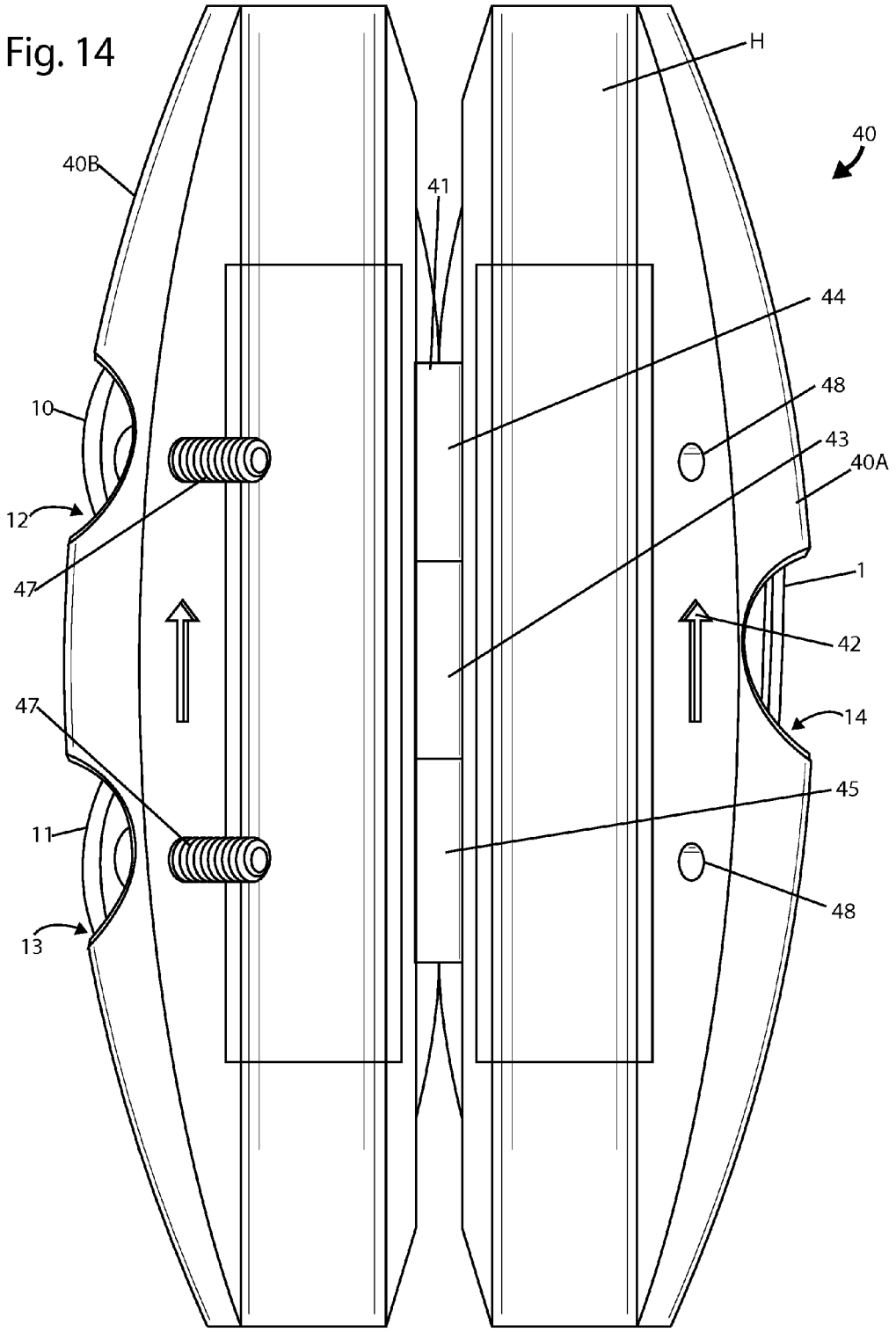
FIG. 14 is a side elevation view of a hinged embodiment in the open position.
Figure 15:
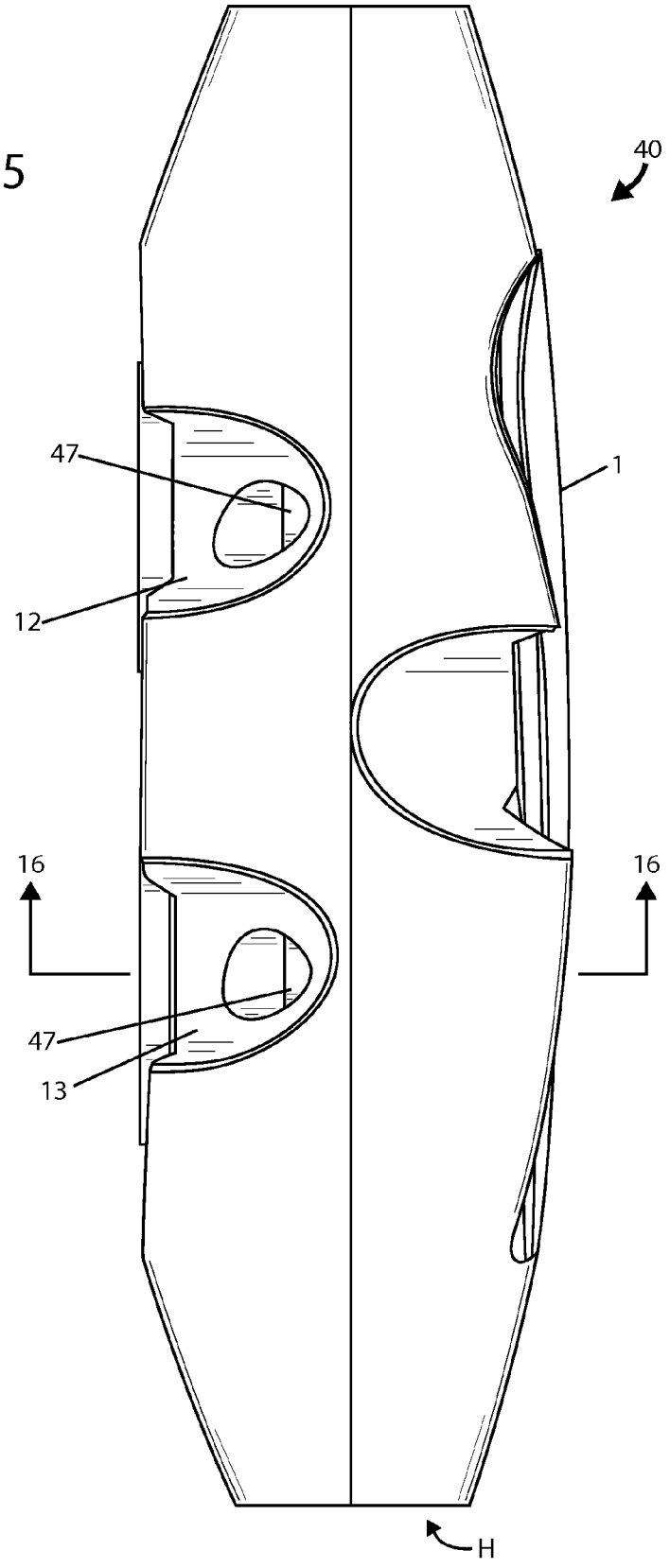
FIG. 15 is a side elevation view of the hinged embodiment in the closed position.
Figure 16:
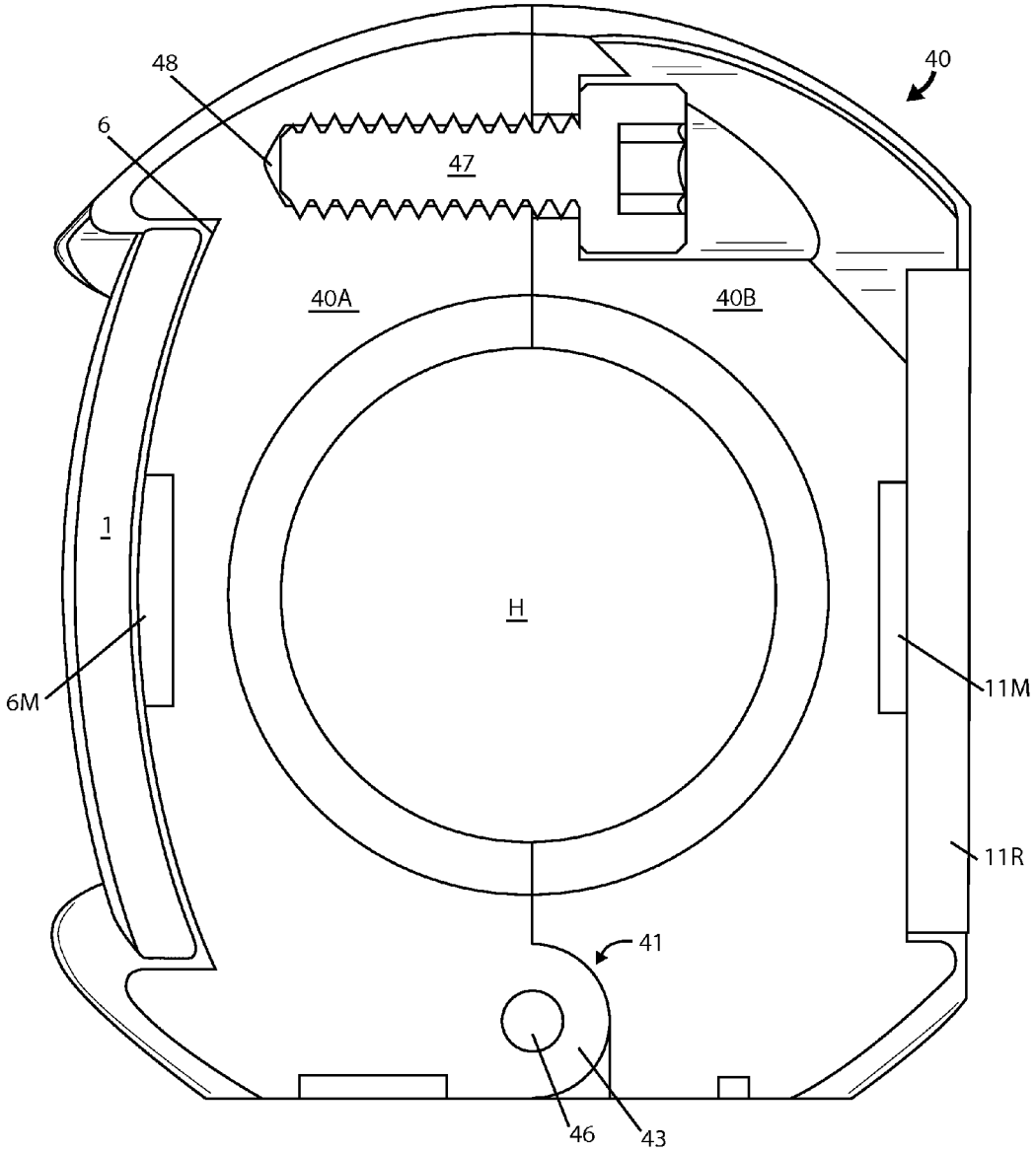
FIG. 16 is a cross sectional view of the hinged embodiment taken along line 16-16 of FIG. 15.

Referring next to FIGS. 14, 15, 16 a hinged collar 40 functions the same as the collar 4 shown in FIG. 7. Divot repair tool half 40A has a hinge 41 connecting it to ball marker half 40B. Arrows 42 show the up position for mounting on the putter shaft.

Cylindrical hinge member 43 fits between end members 44, 45, and pin 46 locks members 43, 44, 45 together in a known manner. Bolts 47 thread into holes 48 to lock a shaft 91 into hollow H in use. An equivalent to the bolts 47 (not shown) could be a snap.

The product will also be installed with another strip of spongy or compressive tape (not shown) that will be adhered to the club shaft after the housing had been test fitted with the club shaft. The installer will decide if tape is necessary and if so, how much tape to use. The tightening of the screws 5 will compress the tape to close the gap between the shaft and the housing to ensure a good fit.

The design of the housing includes three ergonomically designed cutouts 12, 13, 14 to allow for a finger and thumb to easily grab the tools to remove them from their nests in the housing.

The divot repair tool has a unique nest, recess 6, to self align the tool into place while installing it into the housing for storage.

The device has been manufactured by an injection molding process using a common thermoplastic, acrylonitrilie butadiene styrene, commonly known as ABS. Thermoplastics and/or thermosetting plastic or other materials including metals, glasses, and elastomers are commonly used for injection molding processes. For these molding processes an engineer or moldmaker designs and casts a mold, usually of steel or aluminum, that is precision-machined to form the features of the desired part. Desired material is fed into a heated barrel, mixed and forced into the mold cavity where it cools and hardens to the configuration of the cavity.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A collar for attachment to a golf club shaft, said collar comprising:

a. a first and a second half;

b. wherein the first half has a recess to receive a divot repair tool;

c. wherein the second half has at least one recess to receive a ball marker;

d. wherein a hollow sized to surround a golf club shaft is formed between the first and second half when they are joined together; and e. wherein there is a means for securing the first half to the second half when placed on a golf club shaft.

2. The collar of claim 1, wherein the means for securing the first half to the second half further comprises a plurality of aligned holes between the first and second half, wherein a bolt passes through each set of aligned holes and threads into a distal half.

3. The collar of claim 2, wherein the recess to receive a divot repair tool further comprises a magnet, and the divot repair tool further comprises a construction having metal.

4. The collar of claim 2, wherein the recess to receive the ball marker further comprises a magnet, and the ball marker further comprises a construction having metal.

5. The collar of claim 1, wherein the collar further comprises a football like shape.

6. The collar of claim 1, wherein the hollow further comprises a pad to accommodate a diameter of the golf club shaft.

7. The collar of claim 1, wherein the means for securing the first half to the second half further comprises a hinge connection between the first and second halves and a bolt connecting the halves at a distal portion of the halves relative to the hinge connection.

8. The collar of claim 1, wherein the means for securing the first half to the second half further comprises a hinge connection between the first and second halves, and a closure means on a side opposite the hinge connection.

9. The collar of claim 8, wherein the closure means further comprises a snap.

10. In a green repairing tool and ball marker housing, said housing adapted for mounting under a handle on a shaft of a putter, the improvement comprising:

said housing having a two piece construction forming a first half fittingly engaged with a second half;

a connection means functioning to join said first half to said second half;

a hollow running lengthwise between said halves in a closed position, wherein said hollow is sized to clasp the shaft of the putter; and said housing having a recess for a green repairing tool and a recess for a ball marker.

11. The housing of claim 10, wherein the connection means further comprises a plurality of aligned holes and bolts threaded therethrough.

12. The housing of claim 10, wherein the connecting means further comprises a hinge joining a pair of adjacent sides of the housing, and a locking means joining a side opposite the hinge.

13. The housing of claim 10, wherein the first half further comprises the recess for the green repairing tool.

14. The housing of claim 13, wherein the recess for the green repairing tool further comprises a magnet.

15. The housing of claim 13, wherein the second half further comprises the recess for the ball marker.

16. The housing of claim 15, wherein the recess for the ball marker further comprises a magnet.

17. The housing of claim 10, wherein each recess further comprises a finger cutout.

* * * * *